US005420898A

United States Patent [19]

Steagall

[11] Patent Number: 5,420,898

[45] Date of Patent: May 30, 1995

[54] REMOTE MANIPULATOR

[75] Inventor: James A. Steagall, Chattanooga, Tenn.

[73] Assignee: Combustion Engineering, Inc., Windsor, Conn.

[21] Appl. No.: 852,690

[22] Filed: Mar. 17, 1992

[51] Int. Cl.[6] ..... G21C 17/00

[52] U.S. Cl. ..... 376/252; 376/204; 376/249

[58] Field of Search ..... 376/249, 252, 204; 73/634, 637; 976/DIG. 214

[56] References Cited

U.S. PATENT DOCUMENTS

| | | | |
|---|---|---|---|
| 3,934,457 | 1/1976 | Clark et al. | 73/67.85 |
| 4,117,733 | 10/1978 | Gugel | 73/634 |
| 4,368,644 | 1/1983 | Wentzell et al. | 73/634 |
| 4,432,271 | 2/1984 | Wentzell et al. | 91/527 |
| 4,576,034 | 3/1986 | Ferree et al. | 73/1 DV |
| 4,624,400 | 11/1986 | Zimmer | 226/188 |
| 4,658,649 | 4/1987 | Brook | 73/624 |
| 4,672,741 | 6/1987 | Zafred et al. | 29/726 |
| 4,901,578 | 2/1990 | Brill, III | 73/623 |
| 5,042,861 | 8/1991 | Trundle et al. | 294/19.1 |

OTHER PUBLICATIONS

The Nuclear Reactor Vessel Inspection Tool Using an Ultrasonic Method by Yamaguchi Conference on Periodic Inspection of Pressure Vessels. London, England (Sep. 11) May 1972.

*Primary Examiner*—Donald P. Walsh
*Assistant Examiner*—Meena Chelliah
*Attorney, Agent, or Firm*—L. James Ristas; John H. Mulholland

[57] ABSTRACT

The manipulator has a base including an elongated bar having a center between first and second opposed ends. Fluidly actuated end effectors at the first and second ends of the base, are extensible for bracing the base against opposed support surfaces on the steam generator, such as locator pins situated within the clamp ring. A rigid arm is connected to the center of the base and extends radially to a free end. A first drive means is provided for remotely rotating the arm around a rotation axis passing through the center perpendicularly to the base. The preferred transducer means include a bracket situated at the free end of the arm, a pair of radially spaced apart mounting posts supported by the bracket and extending in parallel with the rotation axis, and a transducer shoe assembly carried by each post. A transducer element is mounted in each of the shoe assemblies. A second drive means is carried by the arm and connected to the bracket for remotely adjusting the radial position of the transducer means at the arm free end. Preferably, the posts and transducer elements are spaced apart so as to straddle the clamp ring in the steam generator head. By adjusting the radial position of the posts after each 360° revolution of the arm, substantially all of the annular region of clad material immediately adjacent the ring, can quickly be inspected.

13 Claims, 4 Drawing Sheets

REMOTE MANIPULATOR

BACKGROUND OF THE INVENTION

The present invention relates to the remote servicing of nuclear steam generators, and more particularly, to the ultrasonic inspection of the lower head area of a nuclear steam generator.

With the increasing concerns over scheduling and minimising exposure to workmen's radiation, utilities are looking for ways to improve tooling and techniques associated with the maintenance of steam generators. The use of nozzle dams to seal off the lower head area of a steam generator from the refueling pool of the nuclear reactor, has been used as a way of reducing outage time for maintenance, by permitting parallel activities at the refueling pool and within the drained steam generator.

Some nozzle dams are secured in place against a clamp ring that is, in effect, an integral part of the internal wall of the steam generator. Because the clamp ring was not originally intended to accommodate the high loads imposed by the nozzle dam in use, some concern has arisen regarding the need to inspect the region immediately surrounding the clamp ring. In particular, since the internal wall surface of the steam generator is clad with anti-corrosive material, and the clamp ring is welded to the clad, the desirability of confirming intimate bonding between the clad and the base metal in the region around the clamp ring, has grown in importance.

As with other steam generator inspection related techniques, it is desirable that this particular inspection be accomplished with a minimal radiation exposure to the operators, and in a relatively short period of time.

SUMMARY OF THE INVENTION

It is, accordingly, an object of the present invention to provide a remote manipulator for inspecting an annular region surrounding the internal penetration of a substantially cylindrical bore in the wall of a nuclear steam generator.

In particular, it is an object to provide a remote manipulator for inspecting an annular region adjacent to a raised ring circumscribing the internal penetration of a substantially cylindrical nozzle bore in the wall of a nuclear steam generator.

In accordance with one embodiment of the present invention, the manipulator has a base including a center, and means for rigidly supporting the base with the center of the base on the bore axis. A rigid arm is connected to the center of the base, and extends radially from the center to a free end. A first drive means is provided for remotely rotating the arm around a rotation axis that is coaxial with the bore axis. Ultrasonic transducer means are mounted at the arm free end, and extend substantially in parallel with the rotation axis. A second drive means for remotely adjusting the radial position of the transducer means at the arm free end, enables the transducer means to be positioned at the same distance from the rotation axis as the annular region is from the bore axis.

A more specific embodiment of the manipulator has a base including an elongated bar having a center between first and second opposed ends. Fluidly actuated end effectors at the first and second ends of the base, are extensible for bracing the base against opposed support surfaces on the steam generator, such as locator pins situated within the clamp ring. A rigid arm is connected to the center of the base and extends radially to a free end. A first drive means is provided for remotely rotating the arm around a rotation axis passing through the center perpendicularly to the base. The preferred transducer means include a bracket situated at the free end of the arm, a pair of radially spaced apart mounting posts supported by the bracket and extending in parallel with the rotation axis, and a transducer shoe assembly carried by each post. A transducer element is mounted in each of the shoe assemblies. A second drive means is carried by the arm and connected to the bracket for remotely adjusting the radial position of the transducer means at the arm free end. Preferably, the posts and transducer elements are spaced apart so as to straddle the clamp ring in the steam generator head. By adjusting the radial position of the posts after each 360° revolution of the arm, substantially all of the annular region of clad material immediately adjacent the ring, can quickly be inspected.

The manipulator is relatively compact, lightweight, and easily deployed. Once secured in place in the steam generator head, the entire region of interest can be ultrasonically inspected without operator presence in the steam generator head.

BRIEF DESCRIPTION OF THE DRAWINGS

These and other objects and advantages of the invention will be described below with reference to the preferred embodiment as shown in the accompanying drawings, in which like numerals represent like structure, and in which.

DESCRIPTION OF THE PREFERRED EMBODIMENT

Figure 1:
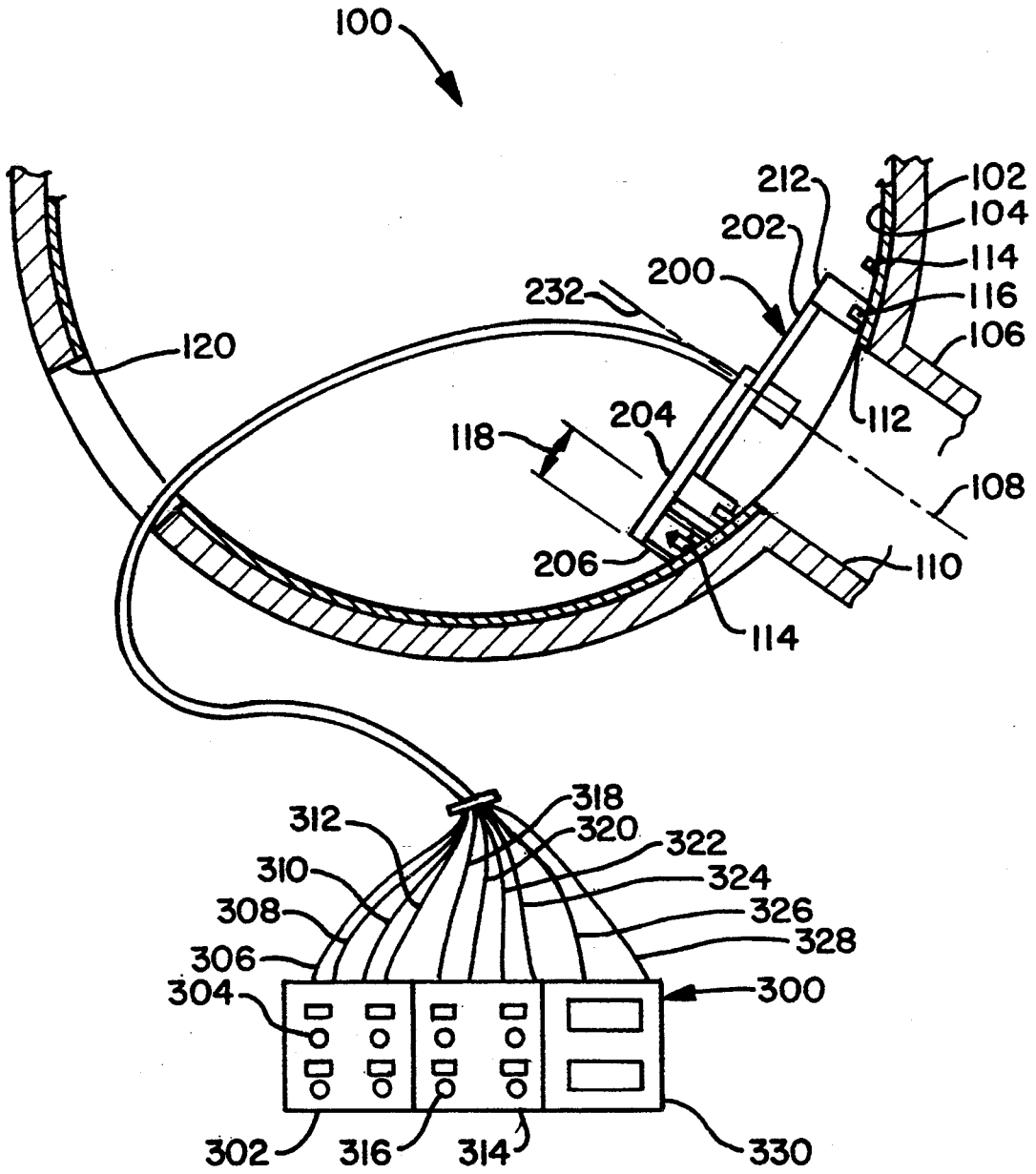
FIG. 1 is a schematic representation of the lower head area of a nuclear steam generator, with the remote manipulator of the present invention in place preparatory to operation.

FIG. 1 shows the lower head 100 of a nuclear steam generator for a pressurized water nuclear steam supply system. The head includes a substantially semi-hemispherical shell having outer and inner walls 102, 104, the inner wall of which consists of clad material bonded onto base metal. Typically, several substantially cylindrical, or somewhat tapered penetrations, such as nozzle 106, are formed in the lower head. The nozzle 106 is, during certain outages, to be sealed by a steam generator nozzle dam (not shown). The nozzle may be viewed as a bore having an axis 108 and a bore wall 110, the intersection of which with the inner wall 104, defines a substantially circular penetration line 112.

Figure 2:
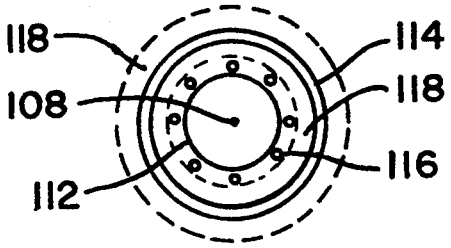
FIG. 2 is a schematic plan view representation of the portion of the internal wall of the steam generator penetrated by the nozzle, showing the region to be inspected, adjacent the clamp ring.

As also shown in FIG. 2, a substantially circular clamp ring 114 is rigidly and typically integrally formed, or welded, to the inner wall 104. Typically, a plurality of clamp ring pins 116 are spaced in a substantially circular pattern between the penetration line 112 and the ring 114.

The purpose of the present invention is to ultrasonically inspect an annular region 118, adjacent the inner and outer sides of the clamp ring 114.

The manipulator 200 includes a base 202 which is rigidly supported relative to the steam generator wall 104, a radially extending arm 204 which is rotatable through 360° about a rotation axis coaxial with the bore center line 108, and a transducer assembly 206 that straddles the clamp ring 114 and carries transducer elements which detect the degree of bonding between the cladding and base metal, along the annulae adjacent the full inner and outer circumferences of ring 114.

A control system 300 is operatively connected to the manipulator 200 for providing pneumatic and electic power, a supply of water for the transducer elements, and the necessary control and data acquisition and monitoring functions, to be described more fully below.

Figures 3, 3A:
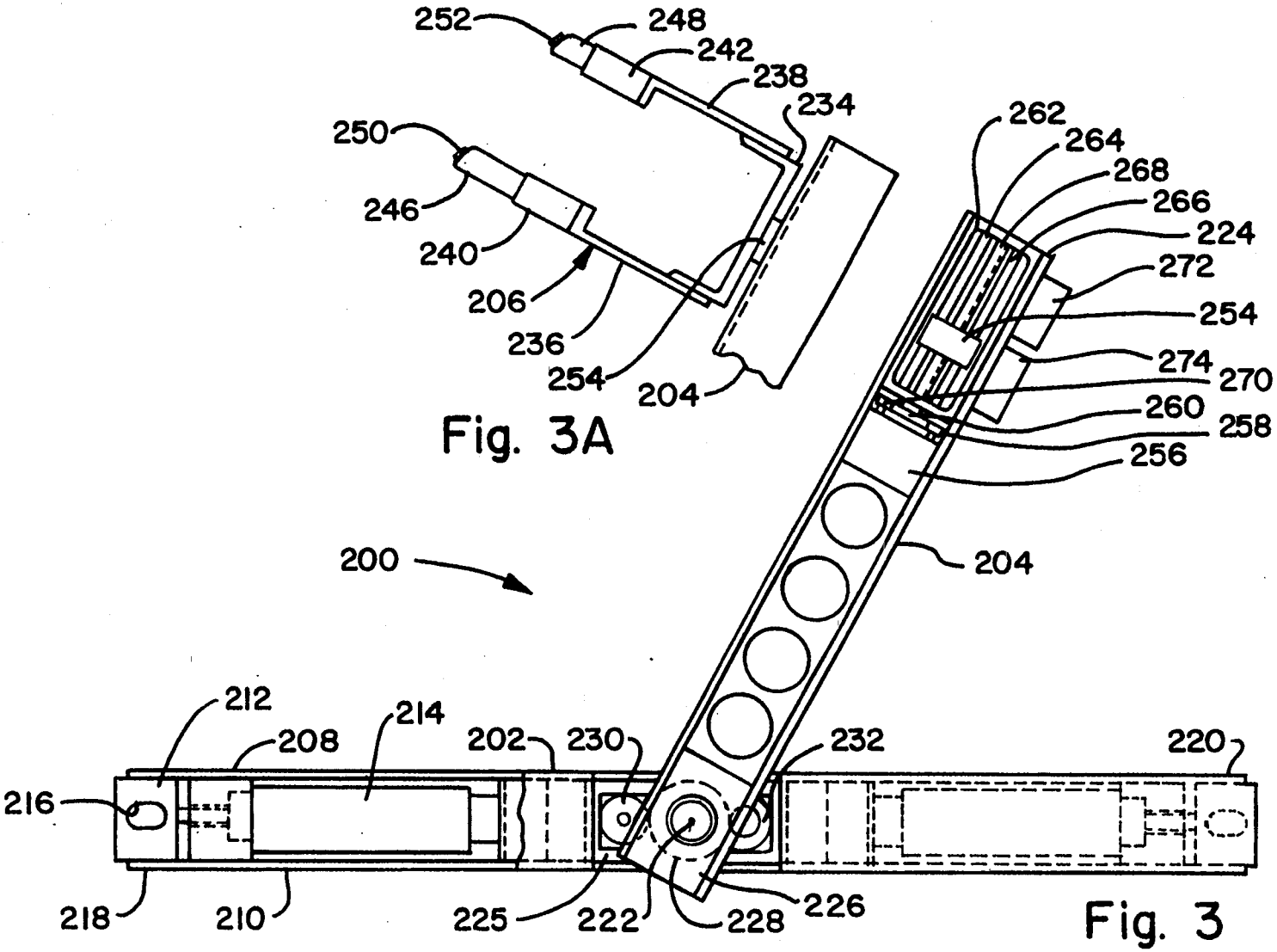
FIG. 3 is a composite view of the manipulator according to the present invention, with the transducer means shown rotated into the plane of the figure for clarity.
Figure 3B:
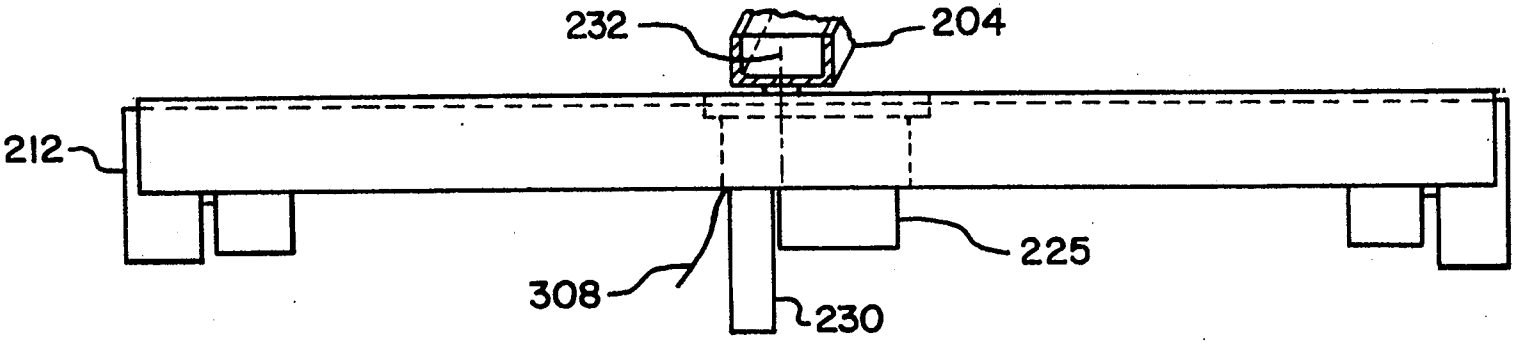

With reference now to FIGS. 1 through 3, the manipulator 200 will be described in greater detail. The base 202 is preferably in the form of an elongated bar including parallel rails 208, 210 and a first end 218 and second end 220. As shown on the left side of base 202, a slide block 212 is mounted for longitudinal movement within the rails 208, 210, by means of a linear drive device such as air cylinder 214 and associated piston and rod. The slide block 212 includes a recess or the like 216 which, in the preferred embodiment, is adapted to fit over one of the ring pins 116 at the inside wall 104 of the steam generator 100. The right side of base 202 is identical to the left side described immediately above, such that, by engaging diametrically opposed pins 116 and extending the slide blocks outwardly with balanced forces, the base is stabilized as a diametric span across the penetration line 112. The center 222 of the base 202 is thus situated on the nozzle axis 108.

The arm 204 extends rigidly from the center of the base, in a radial direction relative to the nozzle axis 108, and has a free end 224 which, in general, would be farther from the base center 222 than the distance from the base center to either end 218, 220. The arm 204 is mounted for rotation, preferably by an inter-connection between a first drive block 225 at the center of the base 202, and a pivet block 226 at the radially inner end of the arm 204. The drive block 225 preferably includes a drive motor 230 which engages a rotational gear 228 in pivet block 226. In this manner, the center 222 of the base 202 defines an axis of rotation 232 that is coaxial with axis 108 when the manipulator 200 is properly secured at the nozzle penetration 112. The first drive block 225 preferably includes an optical encoder 232 or similar means for measuring the rotational movement of arm 204. For example, the optical encoder 232 can engage rotational gear 228.

Arm 204 is preferably in the form of parallel rails with an intervening web having a plurality of cut-outs, to optimize the strength-to-weight ratio. The transducer assembly 206 is preferably mounted at the free end 224 of the arm, so as to be adjustable along the radius of the arm. This is preferably accomplished by providing a transducer bracket, such as U-shaped member 234, secured to a moving block, such as a bronze threaded block 254, that can be driven in the radial direction along a lead screw or the like 268.

The transducer assembly as shown, includes a pair of spaced apart posts 236, 238, which extend parallel to the axis of rotation 232, i.e., below the plane of the drawing shown as FIG. 3. The transducer assembly is shown in the plane of FIG. 3, only for clarity. The posts 236, 238 are adjustable relative to the bracket 234, to accommodate variations from steam generator to steam generator, in the curvature of the inner wall 104 and the relationship of the pins 116 and ring 114. Each post has a mounting shoulder, on which a spring loaded shoe sub-assembly 240, 242 is secured. Each sub-assembly carries a delrin or similar shoe 246, 248, on the ends of which are situated the ultrasonic transducer elements 250, 252.

The threaded block 254 can be driven in either direction along lead screw 268, thereby radially adjusting the position of the transducer assembly 206 commensurately. Preferably, the lead screw 268 is driven by a drive motor and associated encoder block 256 on which is carried a drive motor 258, a drive gear 260 and an optical encoder 270. The lead screw 268 spans a drive screw block 268 which has spaced apart guide rods 264, 266 along which the threaded block 254 slides as it is threadably advanced or retracted along lead screw 268. As an additional feature for monitoring the operation of the manipulator, two television cameras 272, 274 are pointed generally in the same direction as the posts 236, 238.

Figure 4:
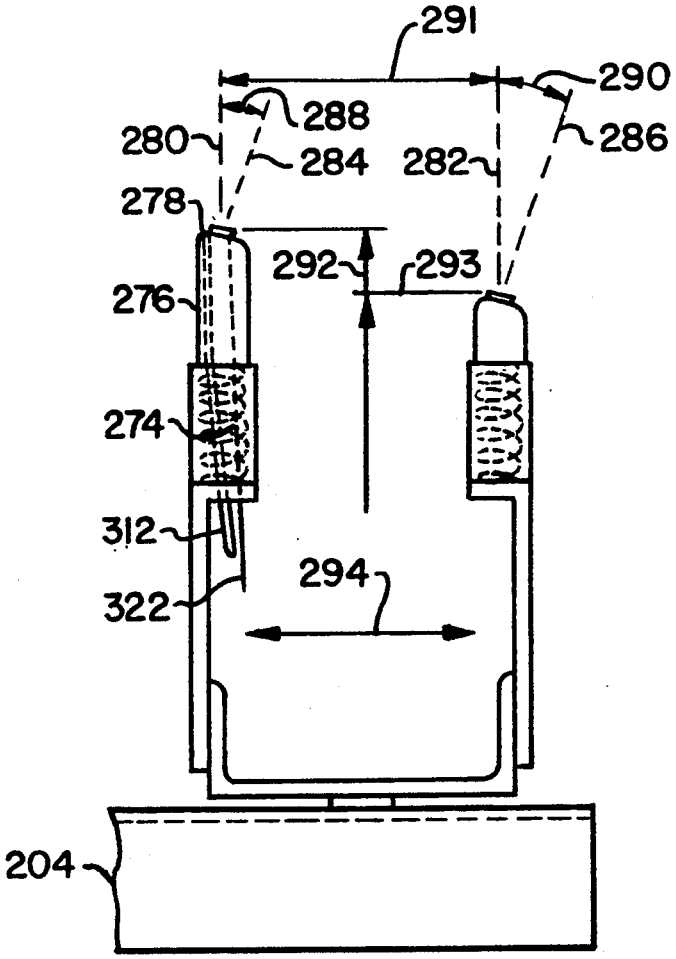
FIG. 4 is an enlarged view of the transducer means shown in FIG. 3.

FIGS. 1 and 4 show the preferred features of the transducer assembly 206 in greater detail. In order to improve the sound transmission from the surface 118 to be inspected, to the transducer elements 250, 252, a coupling fluid, such as water, is delivered through a line such as 312. Line 312 preferably passes through the arm and delivers fluid directly or through passages in the shoes 246, 248, to the terminus of shoes 246, 248. The shoe 246 and associated transducer element 250 on the radially inner post 236, is at a relatively greater distance 292 from the arm 204, than is the transducer element 252 at the end of the radially outer post 238. This difference accommodates the curvature of the wall 104 in the vacinity of the ring 114, as shown in FIG. 1. For the same reason, the center lines 284, 286 of transducer elements 250, 252 are oriented at acute angles 288, 290, in a radially outward direction, i.e., outwardly from the extension lines 280, 282 of the posts 236, 238. The distance 291 between these extension lines 280, 282, is large enough to permit the transducer elements 250, 252 to contact the clad surface radially outside and radially inside the ring 114, while the posts 236, 238 straddle the ring. The straddling and angled transducer center lines could also be achieved orienting at least a portion of the transducer assembly at a slightly outward angle, i.e., not precisely parallel to the rotation axis 232.

Once the manipulator 200 has been set up with the shoe assemblies 240, 242 and if necessary the transducers 250, 252 in contact with the cladding on either side of ring 114, a 360° rotation of arm 204 is activated, while inspection data are recorded. The transducer assembly 206 is then displaced radially by means of the second motor 258, and a rotation of the arm 204 is again completed while data are acquired. By repeating this procedure, an annulus from the outer side of ring 114 outwardly, and from the inner wall of ring 114 inwardly, can be inspected. In order to facilitate the intimate contact between the transducer elements 250, 252, and the clad during rotation of the arm 204, bias means, such as coil springs 274, are provided in the shoe sub-assembly, to urge the delrin mounting members outwardly, thereby enabling the transducer elements to follow any irregularities in the clad surface. In this manner, the quality of the clad bonding to the base metal can be evaluated to assure that the ring can support the loads expected from the installation and use of the nozzle dam.

Referring again to FIGS. 1, 3 and 4, the control system 300 can be assembled from conventional components in any convenient manner. For clarity of description, the control system is illustrated as having three functional units 302, 314, 330. The first unit 302 includes a plurality of adjustment and display interfaces 304, for delivering an air supply on line 306, and current or voltage variations along lines 308 and 310. A source of water is controlled through line 312. Line 306 supplies the two air cylinders 214 for extending the slide blocks 212 against steam generator support structure. In this context, "steam generator support structure" should be interpreted to mean any rigid structure that is part of, or rigidly connected to, the steam generator inner wall 104 and may include the penetration line 112 or nozzle internal surface 110. Electrical lines 308 and 310 deliver controlled power to the first and second drive means 230, 258, on the base 202 and arm 204 respectively. The water through line 312 is supplied by any convenient path, to the free ends of the transducer shoes 246, 248.

The second control unit 314 has a similar array of adjustment and display means 316 associated with lines 318 and 320 for recording data from encoders 232 and 270 respectively, and with lines 322 and 324 for activating and obtaining response data of the transducer elements 250, 252 respectively. Finally, the tv monitor unit 330 receives and displays video signals from lines 326, 328, which are connected to tv cameras 272, 274 respectively.

Preferably, all the service and control lines are confined in a single sheath or cable which passes through an access opening such as manway 120 and into the base 202 of the manipulator 200, where the lines separate for connection to their respective components.

The control system 300 preferably controls the rotation of the arm 204 and the radial extension and retraction of the transducer assembly 206, for speed, direction, jog, on/off and location, with positional control of +/−0.10 inch. It should be appreciated that in the preferred embodiment, the transducer assembly 206 is positioned radially outwardly of the slide blocks 212, whereby the radially inner transducer 250 inspects an inner annular region between pins 116 and ring 114, while the outer transducer 252 tracks a path in another annulus of similar width, but outside ring 114.

I claim:

1. A remote manipulator for inspecting the inside wall of a nuclear steam generator in an annular region of the wall adjacent to a raised ring projecting inwardly from the wall and circumscribing a substantially cylindrical bore penetrating the steam generator wall, comprising:

a base having a center;

means for rigidly supporting the base with the center of the base on the bore axis, said means including means for engaging support structure projecting from the wall of the steam generator adjacent to said ring;

a rigid arm connected to the center of the base and extending radially from the center to a free end;

first drive means for remotely rotating the arm around a rotation axis that is coaxial with the bore axis through the center of the base;

ultrasonic transducer means mounted at the arm free end and extending substantially in parallel with the rotation axis; and second drive means for remotely adjusting the radial position of the transducer means at said arm free end relative to the rotation axis whereby the transducer means can be positioned at a plurality of radii from the rotation axis and adjacent to said ring, and rotated at each of said selected radii by said first drive means.

2. The manipulator of claim 1, wherein the base is an elongated bar member oriented transversely to the rotation axis of the arm and having first and second opposed ends, and the means for supporting the base include means at the first and second ends for engaging the steam generator wall at a radius from the bore axis that is less than the radius of said annular region.

3. The manipulator of claim 1, wherein the means for supporting the base includes a plurality of radially extensible end effectors for engaging support structure projecting from said wall.

4. The manipulator of claim 1, wherein the transducer means includes, a bracket connected to and radially displaceable by the second drive means, a pair of radially spaced apart mounting posts supported for movement with the bracket and extending substantially in parallel with the rotation axis, a transducer shoe assembly carried by each post, and a transducer element mounted in each shoe assembly.

5. A remote manipulator for inspecting the inside wall of a nuclear steam generator in an annular region of the wall adjacent to a raised ring projecting inwardly from the wall and circumscribing a substantially cylindrical bore penetrating the wall, comprising:

a base including an elongated bar having a center between first and second ends;

means at the first and second ends of the base for rigidly engaging support structure on the steam generator inside wall within the ring and supporting the base with the center of the base on the bore axis;

a rigid arm connected to the center of the base and extending radially from the center to a free end;

first drive means for remotely rotating the arm around a rotation axis that is coaxial with the bore axis through the center, transducer means including, a bracket, a pair of radially spaced apart mounting posts supported by the bracket and extending substantially in parallel with the rotation axis, a transducer shoe assembly carried by each post, and a transducer element mounted in each shoe assembly; and second drive means connected to the bracket for remotely adjusting the radial position of the transducer means at said arm free end, whereby the transducer means is positioned at said annular region.

6. The manipulator of claim 5, wherein the steam generator wall includes a plurality of rigid pins located between the ring and the nozzle penetration, and the means for supporting the base includes a plurality of radially extendable end effectors for engaging two diametrically opposed pins.

7. The manipulator of claim 5, wherein the transducer element on the radially outer post is closer to the arm than the transducer element on the radially inner post.

8. The manipulator of claim 5, wherein the ring has a radial thickness, and the transducer elements are spaced apart a distance greater than the ring thickness.

9. The manipulator of claim 7, wherein each transducer element has a center line which is angularly offset in the radially outward direction.

10. The manipulator of claim 9, wherein each post includes means for adjusting the extension of the post from the bracket, and each shoe assembly includes means for biasing the tranducer element away from the arm.

11. The manipulator of claim 9, wherein the radially outer transducer element extends from the free end a lesser distance than the radially inner transducer element.

12. The manipulator of claim 11, wherein the second drive means includes, guide means extending radially within the arm, a lead screw extending in parallel with the guide means, a block member slidingly engaging the guide means and threadably engaging the lead screw, a drive motor engaging the lead screw, and means for connecting said bracket to the block member for radial displacement therewith as the lead screw is turned by the motor.

13. The manipulator of claim 5, wherein the transducer means includes, a bracket, a pair of radially spaced apart mounting posts supported by the bracket and extending in parallel with the rotation axis, a transducer shoe assembly carried by each post, and a transducer element mounted in each shoe assembly.

* * * * *

UNITED STATES PATENT AND TRADEMARK OFFICE

CERTIFICATE OF CORRECTION

PATENT NO. : 5,420,898

DATED : May 30, 1995

INVENTOR(S) : James A. Steagall

It is certified that error appears in the above-indentified patent and that said Letters Patent is hereby corrected as shown below:

Column 7, line 16, "9" should read --13--.

Signed and Sealed this

Fifteenth Day of April, 1997

*Attest:*

BRUCE LEHMAN

*Attesting Officer*

*Commissioner of Patents and Trademarks*